United States Patent [19]

Ke

[11] Patent Number: 4,720,821

[45] Date of Patent: Jan. 19, 1988

[54] TIMER DEVICE

[76] Inventor: Jenn-Yuh Ke, P.O. Box 10780, Taipei, Taiwan

[21] Appl. No.: 826,242

[22] Filed: Feb. 5, 1986

[51] Int. Cl.[4] ..... G04F 8/00; H01H 7/00

[52] U.S. Cl. ..... 368/108; 307/41; 307/141.4

[58] Field of Search ..... 368/107–113, 368/19; 307/38, 41, 43, 140, 141, 141.4, 141.8; 340/309.1, 309.4; 364/143–145, 569

[56] References Cited

U.S. PATENT DOCUMENTS

| | | | |
|---|---|---|---|
| 4,035,661 | 7/1977 | Carlson | 307/141 |
| 4,145,617 | 3/1979 | Lee et al. | 307/43 |
| 4,570,216 | 2/1986 | Chan | 307/141 X |

*Primary Examiner*—Vit W. Miska

[57] ABSTRACT

An improved timer device which incorporates an electronic circuit to offer the user two selectable timer modes, either one-time timing mode or repeat-cycle timing mode. The cycle interval under the a repeat-cycle timing mode can be presetted by the user. The timer device comprises two AC power control circuits to control two loads concurrently.

5 Claims, 1 Drawing Figure

TIMER DEVICE

BACKGROUND OF THE INVENTION

The conventional timers are mostly mechanical type, which can not set the correct time and are easy to be out of order. Although some of conventional timers are electronic type, those timers can only be presetted several daily ON/OFF times within several specified days. There is no way for a conventional electronic timer to operate repeat-cycle timing or to control more than one load concurrently. Traditional electronic timer device can be improved to meet the special timing requirements.

SUMMARY OF THE INVENTION

The major objective of present invention is to offer a repeat-cycle timing device which can continuously operate ON and OFF actions after the cycling interval has been presetted. Therefore the timer device can be applied to air-conditioner control, electrical home appliance control and other industrial control.

The second objective of present invention is to offer a timer device which can concurrently control two loads.

In brief, in accordance with this invention there is provided two cascaded digital counters with the input of the first digital counter connected to a time-base pulse generator and the digital output of the second digital counter connected to a timing interval composition unit. Two switches can select either one of the presetted timing intervals under the repeat-cycle timing mode or one-time timing mode through the timing interval selection unit which is connected to the timing interval composition unit. A bistable circuit will change state when one of the switches sends a pulse and another switch is prevented from sending a pulse. Thereafter a resetted pulse generator will generate a positive pulse to reset two digital counters so as to complete one cycle under the repeat-cycle timing mode. The bistable circuit will only change state one time to reset the digital counters one time under the one-time timing mode.

DETAILED DESCRIPTION OF THE PREFERRED EMBODIMENTS

Figure 1:
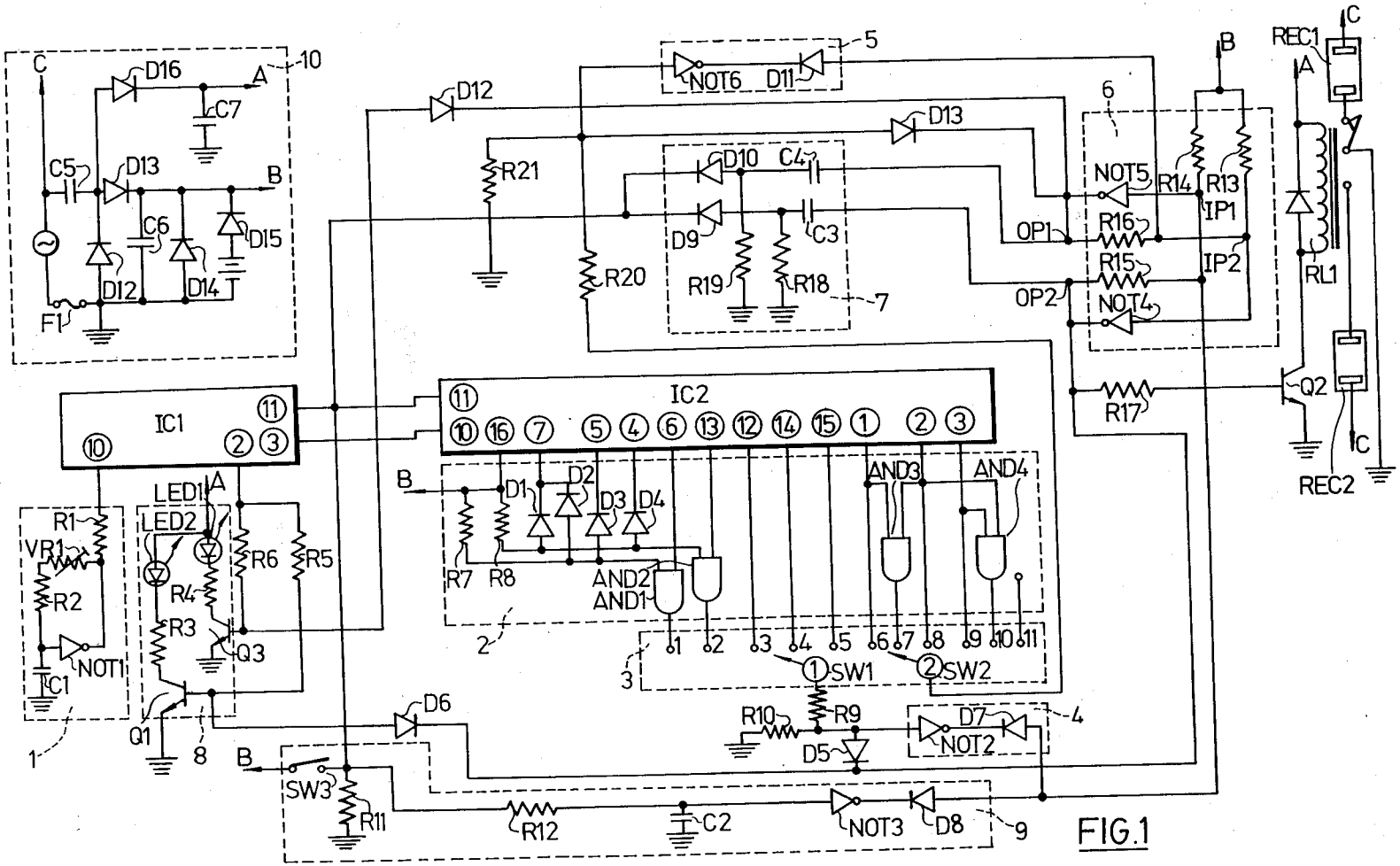
FIG. 1 is a schematic diagram of one embodiment of the present invention.

Both $IC_1$ and $IC_2$ are the same digital counters. The present invention adopts CD 4020 as an example to describe in the following:

CD 4020 is a 16-pinned digital counter with 14-stage digital outputs. Pin 1 is for $Q_{12}$, pin$_2$ for $Q_{13}$, pin 3 for $Q_{14}$, pin 4 for $Q_6$, pin 5 for $Q_5$, pin 6 for $Q_7$, pin 7 for $Q_4$, pin 8 for Vss, pin 9 for $Q_1$, pin 10 for pulse input, pin 11 for reset, pin 12 for $Q_9$, pin 13 for $Q_8$, pin 14 for $Q_{10}$, pin 15 for $Q_{11}$, and pin 16 for $V_{DD}$. Wherein $Q_1$, $Q_4$, $Q_5$, . . . and $Q_{14}$ represent its 14-stage digital output. The inventor herein announced that the adoption of CD 4020 in the embodiment of the present invention is not for confining the scope of the present invention but only for describing the example. Regarding other IC or electronic circuits with a similar function of CD 4020, these are also included in the present invention.

Block 1 is a time-base pulse generator. Time-base pulses are applied to pin 10 (pulse input pin) of $IC_1$ to activate the counting function of $IC_1$. Pin 3 ($Q_{14}$) of $IC_1$ connects to pin 10 (pulse input pin) of $IC_2$, thus the $Q_{14}$ of $IC_1$ is the pulse input of $IC_2$. The frequency of time-base pulse input of $IC_1$ can be changed by adjusting variable resistor $VR_1$ of Block 1 so as to change the frequency of the output pulse in pin 3 of $IC_1$. Therefore the frequency of the time-base pulse input of $IC_2$ can be changed accordingly, so as to change the presetted interval of a repeat-cycle timer which is controlled by $IC_2$. IC1 along with block 1 is incorporated as a time-base pulse generator, with adjustable time-base interval for IC2

Pins 7, 5, 4, 6, 13, 12, 14, 15, 1, 2, and 3 of IC2 are respectively digital outputs of $Q_4$, $Q_5$, $Q_6$, $Q_7$, $Q_8$, $Q_9$, $Q_{10}$ $Q_{11}$, $Q_{12}$, $Q_{13}$, and $Q_{14}$. The above-mentioned digital outputs are connected to a timing interval composition unit as shown in Block 2. The said timing interval composition unit is composed of several AND Gates and diodes to result in ten different interval outputs. This timing interval composition unit is only used for example description. The same timing interval composition unit can also be achieved by incorporating other similar logic circuit. Any minor modifications which cannot be illustrated herein one by one should also be included in the scope of the present invention.

Block 3 is a timing interval selection unit with $SW_1$ which represents switch 1 and $SW_2$ which represents switch 2. Either $SW_1$ or $SW_2$ can be connected to one of the above-mentioned ten different interval outputs to select one of the ten different presetted intervals, for example, 5 minutes, 10 minutes, 30 minutes, 1 hour, 2 hours, 5 hours, . . . and 24 hours etc. Pin 11 of the timing interval selection unit is a null pin which is specially designed for one-time timing mode whose operation will be described in the later paragraph. Therefore both $SW_1$ and $SW_2$ have eleven different selectable positions, ten timing intervals and one null pin.

To facilitate the description of the embodiment of the present invention, $SW_1$ is assumed to be presetted in timing interval $T_1$ and $SW_2$ is assumed to be presetted in timing interval $T_2$ and $T_1$ is less than $T_2$. After timing initiates and time arrives at $T_1$, output of $SW_1$ will turn to HIGH but output of $SW_2$ still remain as LOW, which accordingly make input of NOT Gate $NOT_2$ in Block 4 ($SW_1$ bistable circuit trigger) HIGH and output of $NOT_2$ LOW, therefore diode $D_7$ will be ON, and input point 1, $IP_1$, of the bistable circuit as shown in Block 6 will be LOW accordingly. Input of NOT gate $NOT_6$ in Block 5 ($SW_2$ bistable circuit trigger) will be LOW due to the LOW output of $SW_2$, therefore output of $NOT_6$ will be HIGH, which will make diode $D_{11}$ OFF and input point 2, $IP_2$, of the bistable circuit will be HIGH accordingly. According to the theory of a bistable circuit, output point 1, $OP_1$, of the bistable circuit will be HIGH and output point 2, $OP_2$, will be LOW. This bi-output state, designated as STATE 1, will remain unchanged until $IP_1$ turns to HIGH and concurrently $IP_2$ turns to LOW next time, which will make the bi-state output change, with $OP_1$ changed to LOW and $OP_2$ changed to HIGH so as to designate as STATE 2.

When $OP_2$ remains LOW in STATE 1, the Base of transistor $Q_2$ is also LOW which will make $Q_2$ OFF and accordingly deactivate relay $RL_1$. Therefore reed switch of $RL_1$ will be connected to contact point 1 so as to turn on the Load 1 connected to power receptacle 1, $REC_1$ controlled by contact point 1 of reed switch of $RL_1$. On the hand, Load 2 connected to power receptacle 2, $REC_2$ will be turned off.

As soon, as the bistable circuit turns to STATE 1, $OP_1$ will produce a square wave which thereafter be applied to a capacitor $C_4$, diode $D_{10}$ in reset pulse generator, which is shown in Block 7, to generate a positive pulse. The positive pulse will then be applied to the pin 11 of $IC_1$ and $IC_2$ so as to reset two digital counters $IC_1$, and $IC_2$ simultaneously.

When time arrives at $T_1$ again after resetting, $OP_2$ still remain as LOW to make diode $D_5$ ON. Therefore input of $NOT_2$ will be LOW in spite of output of $SW_1$ being HIGH. Output of $NOT_2$ will be HIGH accordingly to make $D_7$ OFF and thereafter $IP_1$ will be HIGH. In the mean time, output of $SW_2$ remains LOW that will keep the $IP_2$ HIGH just as the same operation described in the former paragraph. Therefore the bistable circuit can not be changed to STATE 2. Diode $D_5$ will prevent $SW_1$ from sending a pulse to Block 4 before $SW_2$ has sent a pulse to Block 5.

When time arrives at $T_2$ after resetting, output of $SW_2$ will turn to HIGH. Therefore input of $NOT_6$ will be HIGH and output of $NOT_6$ will be LOW to make $D_{11}$ ON. $IP_2$ will change to LOW accordingly but $IP_1$ still remains HIGH, that will change the bistable circuit to STATE 2, $OP_1$ to LOW and $OP_2$ to HIGH just as the description in the former paragraph. Then the base of $Q_1$ will be HIGH to make $Q_2$ ON, which will activate the relay $RL_1$. Reed switch will hereby disconnect to a contact point 1 but connect to contact point 2, thereafter to turn off Load 1 which is connected to $REC_1$ and turn on Load 2 which is connected to $REC_2$.

As soon as a bistable circuit turns to STATE 2, $OP_2$ will produce a square wave which thereafter is applied to a capacitor $C_3$ and diode $D_9$ to generate a positive pulse. The said positive pulse will then be applied to the pin 11 of $IC_1$ and $IC_2$ so as to reset two digital counters $IC_1$ and $IC_2$ simultaneously. According to the same operation described in the former paragraph, a diode $D_{13}$ will prevent $SW_2$ from sending a pulse to Block 5 before $SW_1$ has sent a pulse to Block 4.

$SW_1$ and $SW_2$ will send a pulse in turn to a trigger bistable circuit due to the operation of $D_5$ and $D_{13}$, thereafter the repeat-cycle timing mode will be activated. If the $SW_2$ is connected to the null pin, pin 11, of timing interval selection unit, $SW_2$ will be incapable of sending a pulse forever. Therefore the bistable circuit will remain as STATE 1 once the STATE 1 is achieved in the first time, thereafter the one-time timing mode will be activated.

The operation of a switching indicator and timing indicator, as shown in Block 8, will be described as follows: In the STATE 1, during Load 1 turning-on and Load 2 turning-off, $OP_2$ will be LOW, which will make the negative terminal of diode $D_6$ LOW. If the output of pin 2 of $IC_1$ is LOW, the base of transistor $Q_1$ will be LOW. If the output of pin 2 of $IC_1$ is HIGH, hereby the $D_6$ will be ON to keep the base of $Q_1$ still being LOW. No matter what is output status of pin 2 of $IC_1$, the base of $Q_1$ will always remain LOW only if the bistable circuit remains in STATE 1, so as to make $Q_1$ OFF and inactivate $LED_2$, and $OP_1$ will be HIGH, which will make diode $D_{12}$ OFF. Therefore the output pulse of pin 2 of $IC_1$ will continuously apply to the base of $Q_3$ to make $Q_3$ ON and OFF continuously. Hereby $LED_1$ will blink so as to indicate STATE 1. In the STATE 2, during Load 1 turning-off and Load 2 turning-on, will deactivate $LED_1$ and make $LED_2$ blink according to the same operation described above.

A timer inactivating circuit is showed in Block 9. When switch $SW_3$ is ON, a permanent HIGH voltage will be applied to pin 11, reset pin, of $IC_1$ and $IC_1$ to inactivate the timer device.

A power supply circuit is shown in Block 10, the points A and B will output 10 V DC voltage to power on the timer device. When AC power is temporarily turned off, the back-up battery will offer 9 V DC voltage to support the timer device.

I claim:

1. A timer device comprised of two digital counters (with) and a time-base pulse generator with adjustable time-base interval being connected to the pulse input pin of the first digital counter and one of the digital output pins of the first digital counter being connected to the pulse input pin of the second digital counter, to make the first digital counter along with its time-base pulse generator working as a time-base pulse generator with adjustable time-base interval for the second digital counter, a timing interval composition unit being composed of a logic circuit, with the digital output pins of the second digital counter being connected to the said timing interval composition unit to produce a timing pulse for each of several different timing intervals to a plurality of contact points of a timing interval selection unit; two switches, each being connected to one of the contact points of said timing interval selection unit receive said timing pulse or another specially designed null pin so as to select either one of the presetted timing intervals under a (cycling) repeat-cycle timing mode or (one-way fixed) one-time timing mode; two bistable circuit triggers which respectively connect to the two said switches and will send pulse to the inputs of bistable circuit when the said switch receives said timing pulse; a bistable circuit which will change states when one of the said switches sends a pulse through said bistable circuit trigger and the other said switch is prevented from sending a pulse; a reset pulse generator which will generate a positive pulse to reset both digital counters when the said bistable circuit changes state; a relay activating circuit which will activate a relay connected to said bistable circuit when the said bistable circuit changes state so as to turn on one load and turn off another load connected to each respective relay.

2. The invention according to claim 1, further comprising a diode connected to each respective said switch which will be ON response to a switch sending a pulse to keep the said bistable circuit in the same state before the other said switch sends a pulse, so as to prevent the reset pulse generator from resetting the digital counters; and the said bistable circuit will change state only if the other said switch sends a pulse to change the turning ON/OFF status of said loads and to generate a reset pulse to reset the digital counters and thereafter to activate the (cycling) repeat-cycle timing mode.

3. The invention according to claim 1 wherein if one of the said switches is connected to the said null pin to prevent it from sending a pulse, the bistable circuit will achieve one state and means for keeping said bistalbe circuit in this state once the other said switch sends a pulse at the presetted timing interval so as to maintain the turning ON/OFF status of the said loads once the presetted timing interval arrives, thereafter the (one-way fixed) one-time timing mode will be activated.

4. The invention according to claim 1 further comprising an LED switching indicator and an LED timing indicator each having a transistor the bases of which are respectively connected to the two output terminals of said bistable circuit to make one trasistor ON and the other transistor OFF so as to make one LED activated and to make the other LED deactivated to result in a switching status indication; the bases of said two transistors being also connected to one of the digital output pins of the first digital counter to make one of the said LED's blink to provide the function of the said switching indication and timing status indication.

5. The invention according to claim 1 wherein a timer inactivating circuit is connected to both counters to inactivate the said timer device when a switch in said timer inactivating circuit is closed.

* * * * *